US010234219B2

(12) United States Patent
Kowarschik

(10) Patent No.: US 10,234,219 B2
(45) Date of Patent: Mar. 19, 2019

(54) NON-ELECTRIC TEMPERATURE-CONTROLLED BASIN

(71) Applicant: Reis Group Holding GmbH & Co. KG, Obernburg (DE)

(72) Inventor: Nico Kowarschik, Grosswallstadt (DE)

(73) Assignee: KUKA DEUTSCHLAND GMBH, Augsburg (DE)

( * ) Notice: Subject to any disclaimer, the term of this patent is extended or adjusted under 35 U.S.C. 154(b) by 253 days.

(21) Appl. No.: 14/966,252

(22) Filed: Dec. 11, 2015

(65) Prior Publication Data

US 2016/0178296 A1 Jun. 23, 2016

(30) Foreign Application Priority Data

Dec. 19, 2014 (DE) ..... 20 2014 106 176 U

(51) Int. Cl.
*F28F 27/02* (2006.01)
*F25D 17/02* (2006.01)
*F25D 31/00* (2006.01)

(52) U.S. Cl.
CPC ..... *F28F 27/02* (2013.01); *F25D 17/02* (2013.01); *F25D 31/003* (2013.01); *F25D 31/006* (2013.01); *F25D 2331/802* (2013.01); *F25D 2331/804* (2013.01)

(58) Field of Classification Search
CPC ..... F28F 27/02; F25D 17/02; F25D 31/003; F25D 31/006; F25D 2331/802; F25D 2331/804
See application file for complete search history.

(56) References Cited

U.S. PATENT DOCUMENTS

| | | | | |
|---|---|---|---|---|
| 1,652,665 A * | 12/1927 | Frick | F25D 31/006 137/264 |
| 2,431,721 A | 12/1947 | Wiseman et al. | |
| 2,538,016 A * | 1/1951 | Kleist | F25D 16/00 62/139 |
| 2,590,061 A | 3/1952 | Ash | |
| 5,771,956 A | 6/1998 | Kimura | |
| 6,214,136 B1 * | 4/2001 | Yoshimoto | C21D 1/60 148/633 |

FOREIGN PATENT DOCUMENTS

| | | |
|---|---|---|
| CA | 472212 A | 3/1951 |
| CN | 1146941 A | 4/1997 |
| CN | 1833796 A | 9/2006 |
| CN | 101511508 A | 8/2009 |
| CN | 202263921 U | 6/2012 |
| GB | 608057 A | 9/1948 |
| GB | 912102 A | 12/1962 |

OTHER PUBLICATIONS

Non-English European Search Report dated May 3, 2016 for Application No. EP 15 20 0874.
Non-English Chinese Office Action dated May 4, 2017 for Chinese Application No. 201511036109.1 with English translation.
Espacenet English abstract of CN 1833796 A.
Espacenet English abstract of CN 202263921 U.
Espacenet English abstract of CN 101511508 A.

* cited by examiner

*Primary Examiner* — Travis C Ruby
(74) *Attorney, Agent, or Firm* — Ladas & Parry LLP; Malcolm H. MacDonald

(57) ABSTRACT

A non-electric temperature-controlled basin for cooling cast parts, the basin being provided with a liquid, a level sensor, a temperature sensor, and a heat exchanger; and a method for cooling the cast parts.

15 Claims, 1 Drawing Sheet

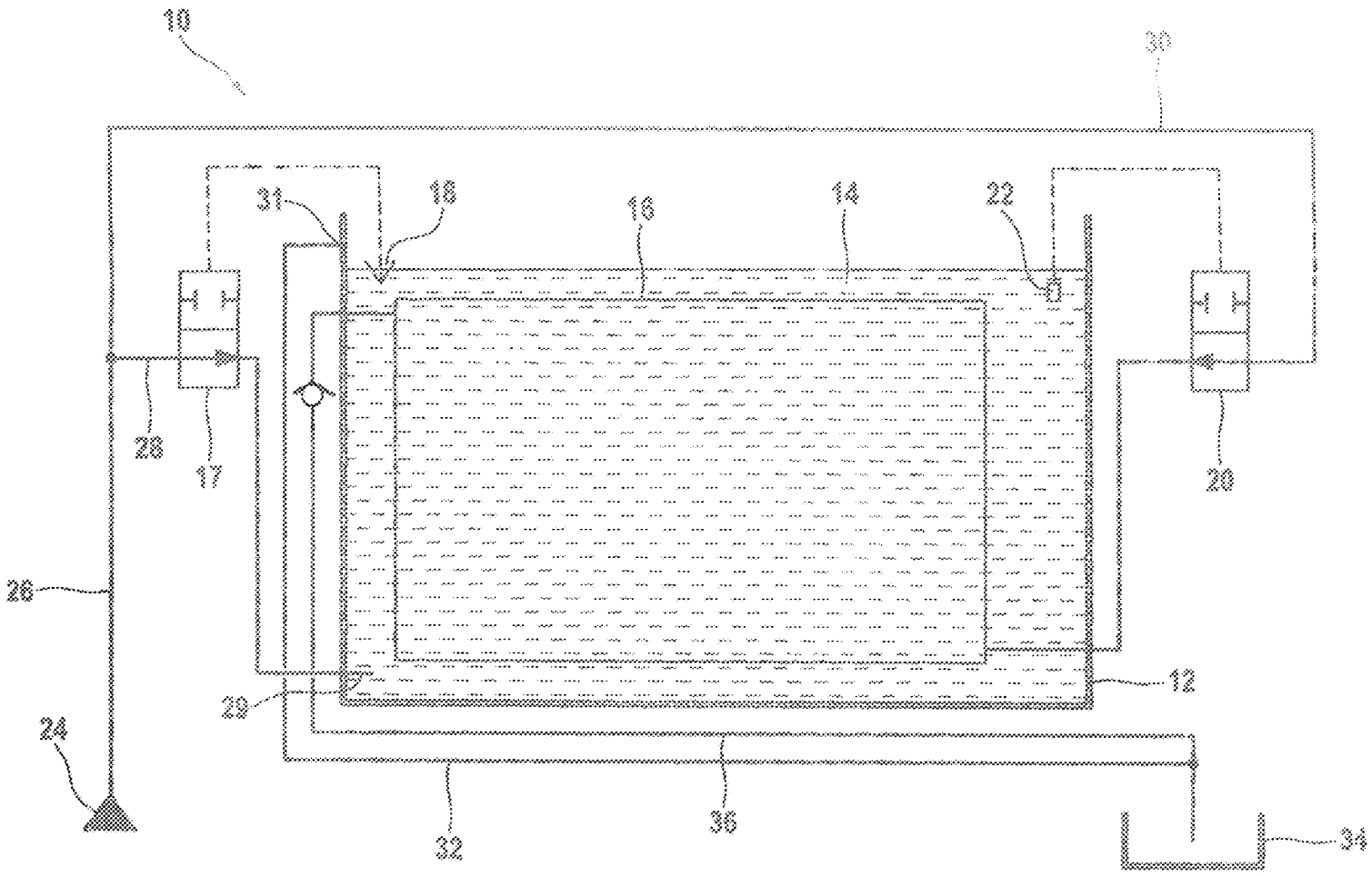
10
30
20
22
14
16
18
31
17
28
26
24
12
29
36
32
34

NON-ELECTRIC TEMPERATURE-CONTROLLED BASIN

This application claims priority to German Application No. 202014106176.2, filed Dec. 19, 2014.

The invention relates to an arrangement for cooling objects, in particular cast parts, comprising a basin containing a liquid and with an inflow and an outflow, level sensor temperature sensor and first means for tempering the liquid in the basin and means for supplying the liquid into the basin.

In order to cool cast parts, so-called immersion cooling basins are used which can be rectangular containers of galvanized steel sheeting or high-grade steel sheeting. In order to monitor the thermal level and the filling level status, temperature sensors and filling status sensors are present in the basin. In order to control the temperature and the filling level, electromagnetically activated valves are used. The water to be cooled is supplied via a circulating pump to a heat exchanger in order to ensure the boundary conditions given by a user.

In order to make a cooling possible, an electrical temperature sensor is usually used which controls an electromagnetic water valve. The minimal filling state is monitored by filling state sensors and by magnetic water valves activated by them. Heat exchangers in the form of pipe systems can be used.

Therefore, components and means of the arrangement are to be supplied with electrical energy in order to be able to cool cast parts in the basin to the required extent. This makes installation measures which are in part expensive necessary. Also, special precautions are to be taken if a basin is to be installed in an ex-protected area.

The present invention has the task of further developing an arrangement of the initially cited type in such a manner that it can be operated without problems taking into consideration the requirements of the user, wherein the installation expense should be reduced in comparison to known constructions.

In order to solve this task the invention provides that the arrangement is operated without current.

According to the invention a self-sufficient arrangement is made available for which electrical energy is not required. To this end it is provided in particular that the means for cooling the liquid comprises a heat exchanger, in particular a heat exchanger plate arranged in the liquid which is connected via a mechanical valve of a mechanical temperature regulator to a line conducting water, wherein the sensing element of the temperature regulator is located in the liquid.

In particular, it is provided that the heat exchanger comprises a water connection running in the bottom area of the basin and comprises a runoff that can optionally be closed by a non-return valve and is located in the head area of the heat exchanger.

Furthermore, the invention is distinguished in that the means for supplying liquid into the basin comprises a line conducting liquid and is connected to the inflow to the basin, wherein a mechanical valve is arranged in the line and is connected by a connecting element to a float present in the liquid of the basin.

Therefore, means for tempering and for regulating the liquid level in the basin are used that operate purely mechanically without electrical energy being required. An installation without electrical lines is possible. Furthermore, a use in an ex-protected space can readily take place.

The invention also has as subject matter a method for cooling objects in a basin filled with liquid and with an inlet and an outlet, filling state sensor, temperature sensor and with a first device for tempering the liquid and a second device for supplying liquid into the basin, wherein the arrangement is operated without current. The first device comprises a heat exchanger such as about exchanger plate arranged in the liquid which is connected to a mechanical valve of a mechanical temperature regulator, whose sensing element is located in the liquid, wherein the valve is connected to a line that conducts liquid. The second device comprises a line or a line conducting the liquid that is connected to the inflow, wherein a mechanical valve of the inflow is arranged in the line and is connected by a connecting element such as a lever to a float present in the basin and located in the liquid.

Other details, advantages and features of the invention result not only from the claims, the features to be gathered from them by themselves and/or in combination, but also from the following description of a preferred exemplary embodiment to be gathered from the drawings.

The single FIGURE is a basic view of an arrangement 10 for cooling in particular cast parts. The arrangement 10 comprises as an essential component a basin 12 that consists, e.g., of galvanized steel sheeting or high-grade sheeting and that is filled with a liquid 14 such as water. Furthermore, a heat exchanger in the form of a thermal plate 16 is present in the basin 12 and is preferably arranged along a longitudinal side of a basin wall in order to cool the liquid 14 to the required extent.

Furthermore, a float valve 17 is provided that is connected by a float 18 floating on or in the liquid 14, in particular by a lever element in order to allow the water to run into the basin 12 as a function of the filling level or to block it. In order to transport the water the water pressure present in the water line is used without any other transport means being required.

In order to regulate the temperature a mechanical temperature regulator, preferably in the form of a thermostat valve 20 is used that is connected to a temperature sensing element 22 located in the liquid 14 for switching the thermostat valve 20.

Furthermore, the basic view shows that a liquid connection such as water connection 24 runs via a line 26 to the float valve 17 (branch 28) as well as to the thermostat valve 20 (branch 30). The branch 28 of the line 26 connected to the float valve 16 empties into an inlet 29 present in the bottom area of the basin 12. A line 32 runs from the head area of the basin 1 and has the function of an overflow line and runs to a water runoff 34. The connection, that is, the runoff is characterized by the reference numeral 31.

The line 30 running to the thermostat valve 20 empties in the bottom area of the heat exchanger 16 and/or of the thermoplate. The runoff of the heat exchanger 16 runs from the head area and via a line 36 to the water runoff 34.

The arrangement 10 can be designated as a self-sufficient system since no electrical energy is required to ensure the required liquid level inside the basin 12 and at the same time to adjust the temperature in such a manner that the necessary cooling of the cast parts to be brought in takes place.

Therefore, the float valve 16 is opened when a liquid level is determined by the float 18 that is below the one to be maintained. In this case the water present on the float 16 and standing under pressure is introduced in the bottom area of the basin 12 until the float 18 closes the float valve 16. To this extent the function of a float valve or filling valve is met, which is a valve controlled by a float, i.e., if a certain liquid level is dropped below, the valve opens and upon the achieving of the theoretical liquid level it closes again.

The water is also under pressure on the thermostat valve 20 and therefore flows into the heat exchanger 16 when the thermostat valve 20 is connected through, that is, the temperature sensing element 22 detects a temperature in the liquid 14 that is above a theoretical temperature. Since the liquid 14 in the heat exchanger 16 is introduced into its bottom area and the flow-off is in the head area, other separate valves are not necessary. However, a mechanically operating non-return valve can be provided in the outlet area or in the line 36.

However, the valve 20 can also operate in a classic manner, i.e., a lower or higher flow-through can take place as a function of the temperature of the liquid 14 in order that the desired liquid temperature prevails in the basin 12.

The invention claimed is:

1. An arrangement for cooling an object, the arrangement comprising:

a basin containing a liquid, and having an inflow and an outflow;

a line conducting the liquid to the basin;

wherein the line branches into a first branch line and a second branch line;

wherein the first branch line extends to the inflow;

wherein the second branch line extends to a heat exchanger disposed in the liquid in the basin;

a float valve in the first branch line for regulating a level of the liquid in the basin;

a temperature valve in the second branch line for regulating a temperature of water supplied to the heat exchanger;

wherein the arrangement is operated without an electrical current being supplied inside the basin.

2. The arrangement according to claim 1, wherein the inflow is located in a bottom area of the basin.

3. The arrangement according to claim 1, wherein the inflow is located in an upper edge area of the basin.

4. The arrangement according to claim 1, wherein the outflow is connected to an overflow line that is connected to a runoff;

wherein a line connects a head area of the heat exchanger with the runoff; and wherein a non-return valve is arranged in the overflow line, or in the line that connects the head area of the heat exchanger with the runoff.

5. The arrangement according to claim 1, wherein the basin consists of galvanized steel sheeting or stainless steel sheeting.

6. The arrangement according to claim 1, wherein the object is a cast part.

7. The arrangement according to claim 1, wherein the heat exchanger is a heat exchanger plate.

8. The arrangement according to claim 1, wherein the float valve comprises a level sensor disposed in the liquid in the basin.

9. The arrangement according to claim 1, wherein the temperature valve comprises a temperature sensor disposed in the liquid in the basin.

10. A method for cooling an object, the method comprising:

providing an arrangement comprising:

a basin containing a liquid, and having an inflow and an outflow;

a line conducting the liquid to the basin;

wherein the line branches into a first branch line and a second branch line;

wherein the first branch line extends to the inflow;

wherein the second branch line extends to a heat exchanger disposed in the liquid in the basin;

a float valve in the first branch line for regulating a level of the liquid in the basin;

a temperature valve in the second branch line for regulating a temperature of water supplied to the heat exchanger;

cooling the object placed in the liquid in the basin; and operating the arrangement without an electrical current being supplied inside the basin.

11. The method according to claim 10, wherein the object is a cast part.

12. The method according to claim 10, wherein the heat exchanger is a heat exchanger plate.

13. The method according to claim 10, comprising providing pressurized liquid to the basin via the inflow.

14. The method according to claim 10, wherein the float valve comprises a level sensor disposed in the liquid in the basin.

15. The method according to claim 10, wherein the temperature valve comprises a temperature sensor disposed in the liquid in the basin.

* * * * *